United States Patent [19]

Company et al.

[11] Patent Number: 4,753,686

[45] Date of Patent: Jun. 28, 1988

[54] REGENERATION OF NICKEL-BASED SUPERALLOY PARTS DAMAGED BY CREEP

[75] Inventors: José Company, Le Coudray Montceau; Alain R. Leonnard, Saint-Michel sur Orge, both of France

[73] Assignee: Societe Nationale d'Etude et de Construction de Moteur d'Aviation "S.N.E.C.M.A.", Paris, France

[21] Appl. No.: 931,883

[22] Filed: Nov. 17, 1986

Related U.S. Application Data

[63] Continuation of Ser. No. 793,907, Nov. 1, 1985, abandoned.

[30] Foreign Application Priority Data

Nov. 8, 1984 [FR] France ..... 84 16974

[51] Int. Cl.[4] ..... C22F 1/10

[52] U.S. Cl. ..... 148/4; 148/11.5 N; 148/162

[58] Field of Search ..... 148/4, 11.5 N, 13, 13.1, 148/12.7 N, 162, 12.3, 426, 427, 428

[56] References Cited

U.S. PATENT DOCUMENTS

| | | | |
|---|---|---|---|
| 3,310,440 | 3/1967 | Piearcey | 148/13 |
| 3,957,542 | 5/1976 | Cina et al. | 148/4 |
| 4,161,412 | 7/1979 | Henry | 148/162 |
| 4,392,894 | 7/1983 | Pearson et al. | 148/12.7 N |

FOREIGN PATENT DOCUMENTS

| | | |
|---|---|---|
| 2292049 | 6/1976 | France . |
| 2313459 | 12/1976 | France . |
| 1516561 | 7/1978 | United Kingdom . |

*Primary Examiner*—L. Dewayne Rutledge
*Assistant Examiner*—S. Kastler
*Attorney, Agent, or Firm*—Oblon, Fisher, Spivak, McClelland & Maier

[57] ABSTRACT

Method for the regeneration of machine parts of a nickel-based alloy, such as turbo-machine blades having reached the end of their useful operational life as a consequence of damage by creep in particular, consisting in holding the part for at least 1 hour at a temperature sufficient to redissolve a volumetric fraction of at least 50% of the $\gamma'$ phase, then controlling its precipitation by controlling the rate of cooling so as to regenerate its microstructural morphology.

9 Claims, 6 Drawing Sheets

REGENERATION OF NICKEL-BASED SUPERALLOY PARTS DAMAGED BY CREEP

This application is a continuation of application Ser. No. 793,907, filed on Nov. 1, 1985, now abandoned.

BACKGROUND OF THE INVENTION

1. Field of the Invention

The invention relates to a method of heat treatment for parts reaching the end of their useful operational life after having suffered damage as a result in particular of creep. The object of the method is to enable them to recover their initial properties so that they may last longer. It relates to machine parts of heat-resistant nickel base alloy comprising a hardening phase $\gamma'$, and applies in particular to turbomachine rotor blades.

Such blades should be able to withstand high temperature creep as they are mounted on a disc which rotates at between 5,000 and 20,000 rpm, while being exposed to hot gases at between 900° C. and 1300° C., having an oxidising effect, issuing from the combustion chamber. Research has therefore been directed towards cast alloys, whose chemical compositions may be optimized, and which are capable of being substantially hardened by precipitation with a view to improving their resistance to fracture as a result of creep. Nickel-based superalloys used in aircraft engineering have a hardening phase $\gamma'$ the volumetric fraction of which may reach 70%.

However, in operation, the rotor blades subjected to such mechanical and thermal stresses suffer permanent elongation through creep, which leads inevitably to their systematic scrapping after a certain number of hours of use so as to avoid the danager of a catastrophic fracture. For example, high pressure rotor blades in a certain number of engines have their useful operational life limited to about 800 hours because of creep.

As this creep deformation process results in a degradation of the microcrystalline structure, the invention has for its object the provision of a thermal treatment method permitting the restoration of the initial structure under conditions compatible with the geometrical criteria of the parts.

2. Description of the Prior Art

In the course of earlier work regeneration treatments have been devised. For example, French Pat. No. 2,292,049 describes a process for extending the duration of the secondary creep of some alloys: it consists in a heat treatment without stress, conducted at a temperature below that for dissolving the compounds. This temperature corresponds in practice to the maximum temperature for the operation of the part; moreover, that temperature is held for quite a long time because it has to permit, according to the hypothesis put forward, the annihilation of the gap and cavity networks by means of a diffusion process. This treatment, restricted in temperature terms, is certainly ineffective for parts having operated at high temperatures, such as 1100° C., for it does not permit the regeneration of the microcrystalline structure. Moreover, its duration makes it uneconomical for industrial application.

As a further example, French Pat. No. 2,313,459 relates to a method of improvement in the continued useability of metal parts which have suffered permanent elongation. It consists in subjecting said parts, before surface cracks appear, to a hot isostatic compression or compacting, at a temperature below that at which an enlargement of the grain takes place, and then in applying a re-dissolving treatment of the phases, followed by a hardening annealing. The importance of the compacting lies in the fact that it closes the decoherence caused by creep and closes any remaining pores formed during casting. This technique, however, is rather cumbersome to implement; it is not justified in all cases. Moreover, the subsequent heat treatment does not permit control of the precipitation mechanisms; neither does it take into account a deterioration of the surface protective layer. Finally it is not capable of economical industrial application.

Alloys of this type designed for use at high temperatures exhibit poor corrosion properties beyond 900° C., particularly in a sulfurizing atmosphere; accordingly they require surface protection which may be a nickel aluminizing coating obtained by thermo-chemical means. The problem posed by this type of protection is that any heat treatment of the part at beyond a certain temperature and for more than a certain period of time causes intermetallic diffusion modifying its chemical composition and its properties. To prevent this, it is normally sufficient to effect a preliminary treatment which removes the said layer. But this operation has been found to be impossible on rotor blades provided with internal cooling channels, as it would unacceptably reduce their already thin wall thickness.

The invention has therefore as its second object the provision of a heat treatment which does not require the preliminary operation of removal of the protective layer.

SUMMARY OF THE INVENTION

The invention provides a method of regeneration of a machine part of cast nickel-based alloy comprising a hardening phase $\gamma'$, at the end of its useful operational life as a result of creep damage, comprising the steps of holding said part at a temperature and for a period of time sufficient to re-dissolve at least 50% of the volumetric fraction of the hardening phase $\gamma'$, said temperature being below the melting temperature of the eutectic, and then cooling the part, comprising controlling the rate of cooling, down to a temperature below the range of temperatures at which precipitation of the $\gamma'$ phase takes place, in accordance with the required microstructural morphology to be regenerated.

DESCRIPTION OF THE DRAWINGS

In order that the invention may be better understood, an example of its application to the alloy known in the trade as IN 100 will now be described, by way of example only, with reference to the accompanying drawings, wherein.

DESCRIPTION OF A PREFERRED EMBODIMENT

Figure 1:
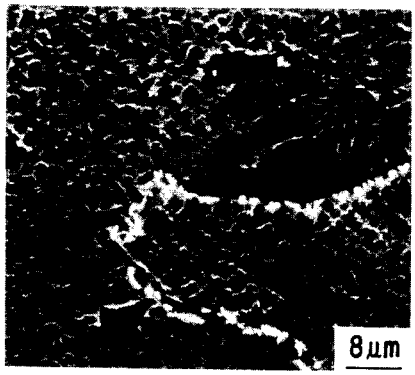
FIGS. 1 and 1A are microphotographs taken with an electron microscope of a blade after 50 hours of operation in an engine.

Alloy IN 100 of formula NK 15 CAT is a cast nickel-based alloy. Its composition is as follows: Cobalt 13 to 17%, chromium 8 to 11%, aluminum 5 to 6%, titanium 4 to 5%, molybdenum 2 to 4%, vanadium 0.7 to 1.7%, carbon 0.1 to 0.2%, etc.

Cast under a vacuum at 1460° C., IN 100 is designed for extended use at 1000° C., or short duration use at 1100° C.

In all cases, its poor corrosion-resistance, particularly in a sulfurizing atmosphere, calls for protection, obtained, e.g. by the steam phase aluminization method of French Patent No. 1,433,497.

From the microstructural point of view, IN 100 exhibits a dendritic structure $\gamma$-$\gamma'$ supporting eutectic aggregates and carbides. The size of the dendrites of the basaltic grain and the morphology of the hardening phase are dependent upon the cooling rate on casting, and thus of the local thickness of matter in the part, and on the B and Zr content. The size ranges from a few tenths of one millimetre to several mm for thicknesses from 1 to 10 mm.

The $\gamma$ matrix, hardened by the effect of frozen Cr and Co in Ni, crystallises in the F.C.C. system. The maximum hardening originates in the precipitation of the $\gamma'$ phase, ordered, of type $L1_2(Cu_3Au)$ of the same crystalline system and in coherence with the matrix. Its volumetric fraction is about 70%. The approximate composition is (Ni,Co)3(Ti,Al). The outstanding mechanical resistance to heat which $\gamma'$ imparts to nickel-based superalloys originates essentially in the flow stresses of this phase which possesses the remarkable property of growing as the temperature rises.

When one considers the $\gamma$-$\gamma'$ alloys, the variation of mechanical resistance with temperature is obviously itself dependent upon the volumetric fraction of $\gamma'$, but is also dependent on the morphology of the precipitates, by virtue of the type of obstacle to the movement of the dislocations that they represent.

Moreover, the alloy is rich in eutectic islands $\gamma$-$\gamma'$, situated in the interdendritic spaces. The temperature of formation of these aggregates depends on their chemistry when passing the solidus, and may vary over wide ranges. Thermal analysis places the temperature between 1210° and 1275° C. depending particularly on the carbon content.

Two types of carbides are seen in IN 100. The primary carbides of MC type, rich in Ti or Ti-Mo, without any orientation relationship with the matrix, appear well before the end of the solidification of the alloy. Secondary carbides, of M 23 C6 type rich in Cr and in orientation relationship with the matrix, precipitate at a lower temperature, between 850° and 1000° C. Experiments have been conducted on aluminized blades of IN 100 alloy in high pressure turbines for an aircraft turbomachine, with internal channels for the passage of cooling air. It will be recalled that the principle of aluminization is to keep the part at a temperature above 1000° C. in an aluminum fluoride atmosphere; in contact with the part, the gas dissociates into atomic aluminum on the surface and into gaseous fluorine which keeps the reaction going. Al combines with the nickel of the part to form the aluminizing which imparts to it its properties of resistance to oxidation.

Microstructural observations were made on these blades in new condition, then in succession on blades having operated for 50, 800 and 1000 hours. The operational conditions correspond approximately to a stress of 130 MPa and a temperature of 1000° C.

The new blade exhibited at its leading edge as well as at its trailing edge a $\gamma$-$\gamma'$ structure rich in eutectics and primary carbides. Two populations of $\gamma'$ precipitates coexisted: "coarse" $\gamma'$ of a size close to 2 $\mu$m, precipitating shortly after the solidification of the alloy, and "fine" $\gamma'$, of a size close to 0.2 $\mu$m, precipitating during the cooling following the protective treatment. In the immediate vicinity of the eutectics, only fine $\gamma'$ was present. Primary carbides precipitated when the alloy had not fully solidifed and were pushed back into the interdendritic sites where the grain boundaries were situated, distinguished essentially by the difference of orientation of the $\gamma'$ between two contiguous grains.

Figure 1A:
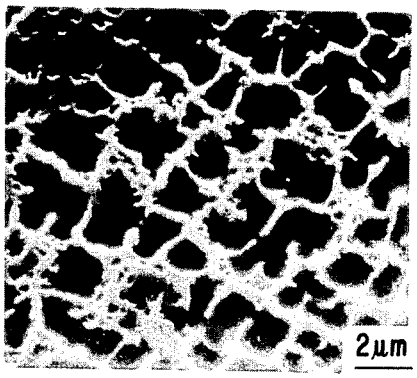

For blades which had been operating for 50 to 800 hours, the first microstructural evolution observed consisted in the precipitation of the integranular secondary carbides, around the primary carbides and at the $\gamma$-$\gamma'$ interfaces of the eutectics, after 50 hours' operation (FIGS. 1 and 1A). For times of increasing operation, precipitation intensified to become intergranular. Along parallel lines, phenomena of coalescence of the $\gamma'$ phase brought about the progressive disappearance of the fine $\gamma'$ precipitates.

Figure 2:
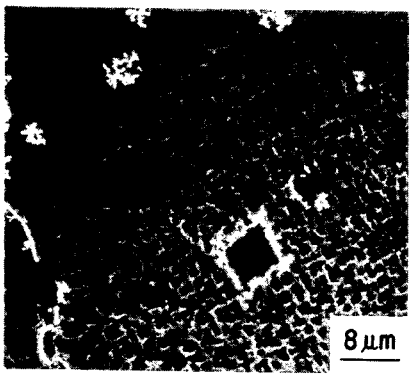
FIGS. 2 and 2A are microphotographs similar to those of FIGS. 1 and 1A, after the blade has been operated for 800 hours.
Figure 2A:
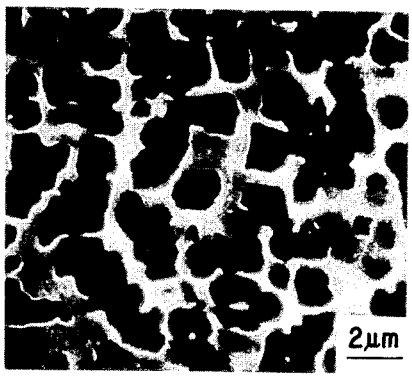

After 800 hours' operation, the size of the $\gamma'$ globules reached 3 to 4 $\mu$m, and may have doubled in the vicinity of the eutectics, primary carbides and grain boundaries (FIGS. 2 and 2A).

Figure 3:
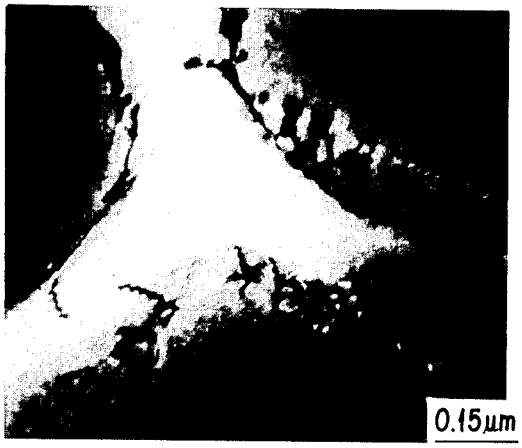
FIGS. 3 and 4 are microphotographs showing the aspect of the interface dislocations $\gamma$-$\gamma'$ after 800 hours of operation.
Figure 4:
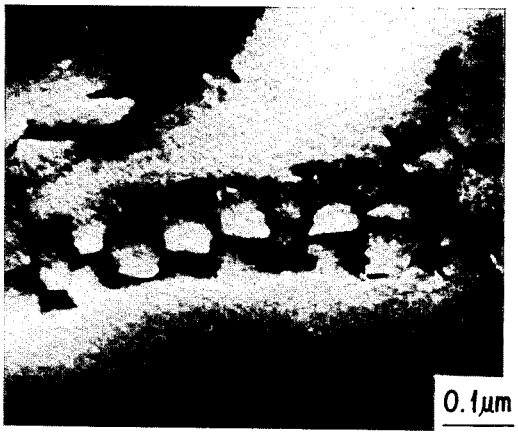

Examinations on thin slides showed a particular arrangement of the $\gamma$-$\gamma'$ interface dislocations and of the M23 C6 - $\gamma'$: a tendency to an arrangement either parallel with the stress of centrifugal origin (FIG. 3), or a polygonization (FIG. 4).

For blades having operated for 1000 hours, the microstructure at the leading edge at the blade centre had a dendritic appearance. The interdendritic spaces were rich in eutectic, and were constituted by $\gamma'$ precipitates substantially greater than at the heart of the dendrites. The geometry of some casting pores showed an incipient deformation, as already observed after 800 hours; the coalescence of the $\gamma'$ phase brought about the disappearance of the fine precipitates.

Transmission electronic micrographic observations confirm the observations made after 800 hours' operation, i.e.:

- coalescence of the $\gamma'$
- orientation of the $\gamma$-$\gamma'$ interface dislocations parallel with centrifugal stress and polygonization on certain globules
- dense and regular network of M23 C6 - $\gamma'$ or M23 C6 - $\gamma$ interface dislocations,
- no anchoring of dislocations in the matrix $\gamma$.

FIGS. 5A to D provide in summarized form a diagrammatic representation of the process of creep damage to the alloy subjected to a stress of 130 MPa and a temperature of 1000° C., particularly observed on test samples.

Figure 5A:
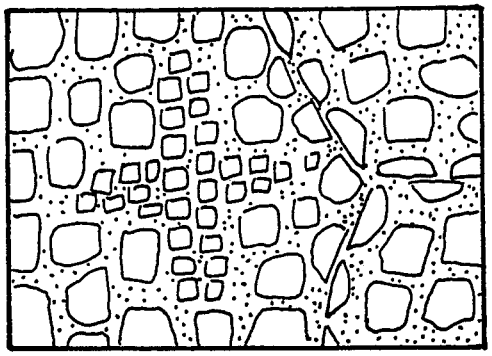
FIGS. 5A to D are diagrammatic representations of the damage process through creep.

FIG. 5A shows the condition of the structure after aluminization. Three populations of $\gamma'$ may be seen: relatively coarse particles of interdendritic $\gamma'$, fine particles of dendritic $\gamma'$, and very fine particles evenly distributed obtained during cooling after the aluminization treatment.

Figure 5B:
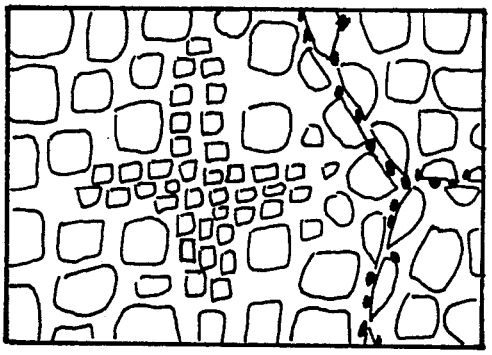

In FIG. 5B, after primary creep, one observes the disappearance of the very fine $\gamma'$, and the precipitation of secondary carbides.

Figure 5C:
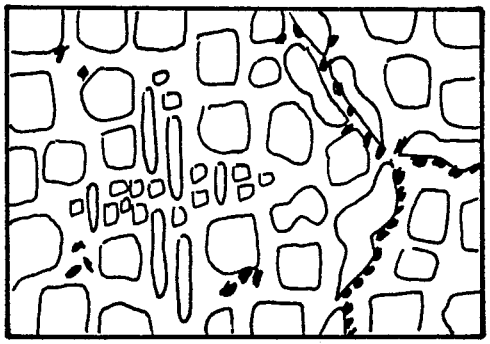

In FIG. 5C after the inception of the secondary creep, the orientated coalescence of the dendritic $\gamma'$ may be observed.

Figure 5D:
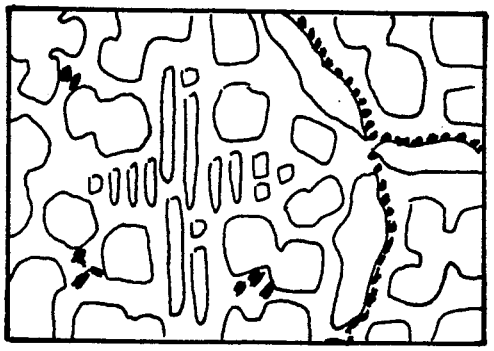

In FIG. 5D at the end of secondary creep, the coalescence of the $\gamma'$ is more marked; it is orientated for the dendritic $\gamma'$ and non-orientated for the interdendritic $\gamma'$.

The study of creep damage given hereinabove has therefore revealed a collection of metallurgical processes controlling deformation.

The preferred method, in accordance with the invention, is as follows. The alloy is subjected to a regeneration treatment for the effects of creep, comprising a heat cycle cancelling the microstructural effects of deformation and leading to a microstructure coming close to that of the alloy before stressing. The part to be treated, such as has been observed, e.g. after 1000 hours' operation, is placed in a furnace, preferably under a vacuum in order to avoid oxidation problems. It is heated to a temperature selected to re-dissolve a volumetric fraction adequate for the hardening phase. In the present case of blades of IN 100 alloy protected by aluminization, this temperature is also determined so as to be consistent with the preservation of its protection; indeed, too high a temperature would bring about the diffusion of the aluminum and the dilution of the nickel aluminizing layer. For the present application, this temperature was chosen at 1190° C., but may vary from case to case between 1160° C. and 1220° C. The choice of temperature is also guided by the need for an adequate margin with the melting temperature of the eutectic with a view to industrial application.

Tests have shown that holding the temperature for less than four hours, and preferably for about one hour, is sufficient to re-dissolve a volumetric fraction of $\gamma'$ phase of at least 50%, which is tantamount to destroying in particular the bonds between $\gamma'$ globules which had developed during creep damage.

After this maintenance of a temperature of 1190° C. for one hour under a vacuum, the part is cooled by the injection of a flow of inert gas, argon, in the furnace. The rate of this flow is controlled in order to control the cooling rate of the part down to a temperature below the range at which precipitation of the $\gamma'$ phase takes place.

It has been found that it is not necessary to control the rate of cooling down to ambient temperature; indeed, below 700° C. the cooling rate has no influence upon precipitation.

Figure 6:
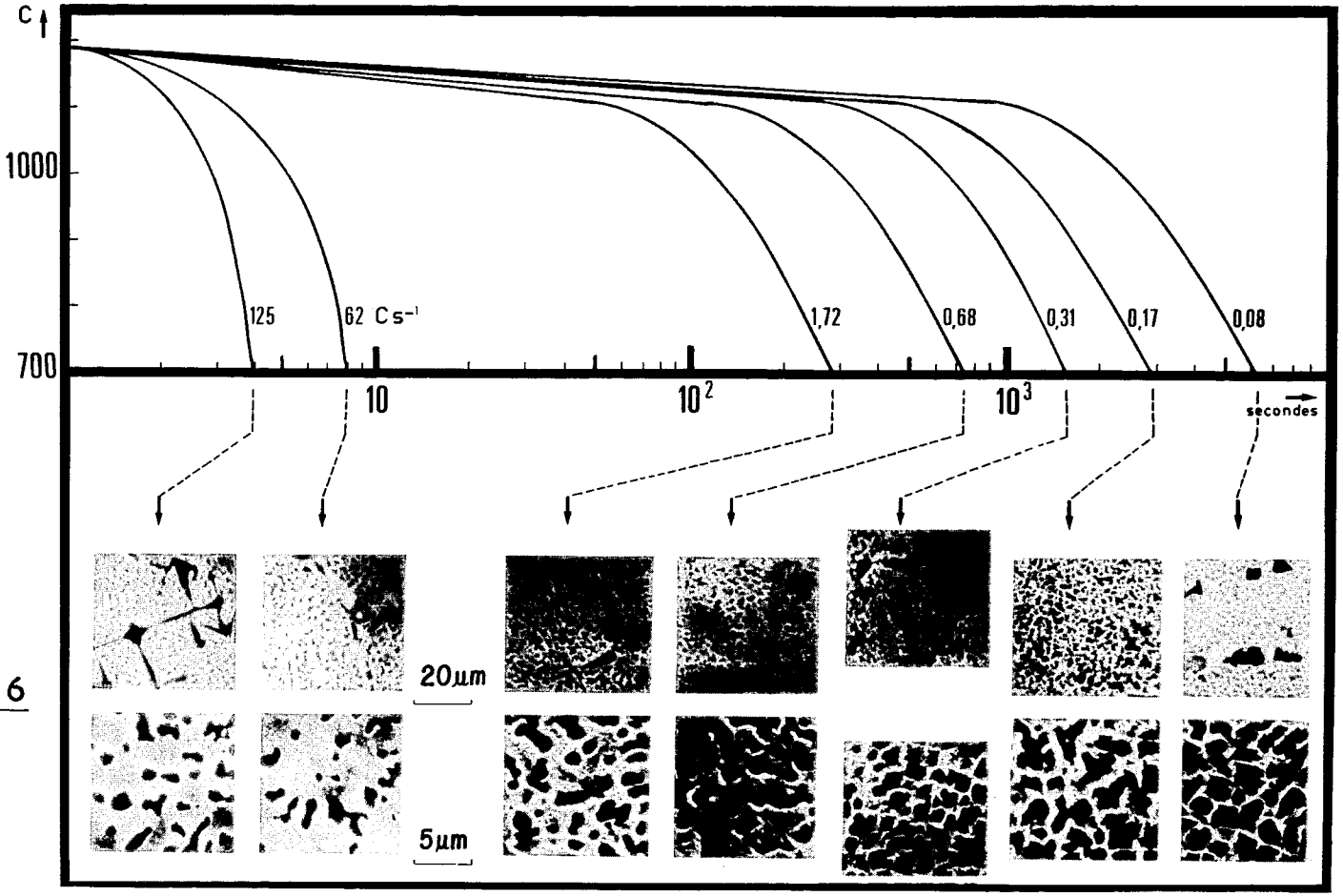
FIG. 6 shows the microstructural evolution of the alloy dependent upon the cooling rate after having been held at 1190° C. for 1 hour under a vacuum.
Figure 7:
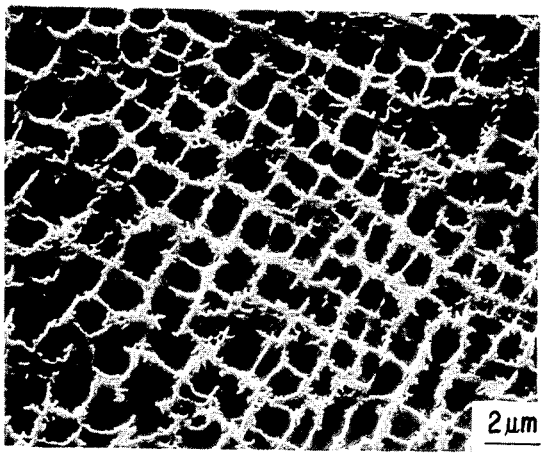
FIGS. 7, 8 and 9 show the microstructural effect of the regeneration treatment, FIG. 7 being a microphotograph of a new blade, FIG. 8 that of a blade having been operating for 1000 hours and FIG. 9 that of a regenerated blade after 1000 hours' operation.
Figure 8:
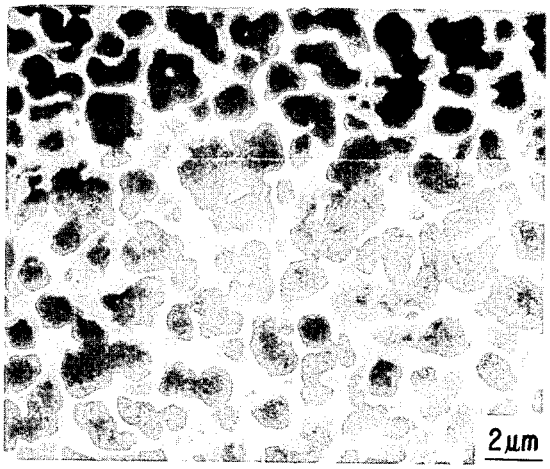
Figure 9:
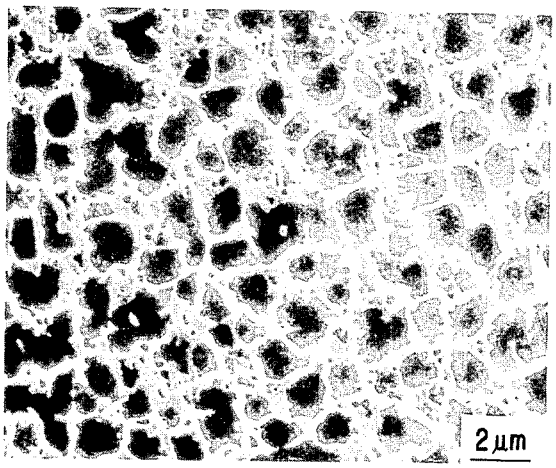

The overall picture of the microstructures obtained is represented in FIG. 6. It will be noted that the argon coolings lead to the precipitation of two populations of $\gamma'$ and that the volumetric fraction of "coarse" $\gamma'$ increases while the content in fine constituents decreases, as the cooling rate is reduced. Microstructural observation discloses a complex phenomenon of "growing germination" and "growth-coalescence" the respective kinetics of which vary depending upon the local chemical composition of the matrix giving rise to the $\gamma'$. There is, therefore, a compromise between the volumetric fractions of coarse $\gamma'$ and of fine $\gamma'$ which secures the best mechanical behaviour according to a given set of criteria. Indeed, a microstructure consisting solely of fine $\gamma'$ precipitates improves creep behaviour, but is detrimental to cold ductility and hot ductility of the alloy. By contrast, slow cooling, leading to a microstructure which would then contain only a population of "coarse" $\gamma'$ would not improve creep behaviour. Depending on the morphology it is desired to obtain, the rate may be controlled between 600° C./h and 2500° C./h. For the present application the best choice lay between 1085° C./h and 1145° C./h, the microstructure of which is shown in FIG. 9. Under these conditions it is no longer possible to differentiate a new blade (FIG. 7) from a regenerated blade (FIG. 9) on examining their microstructure only: the distribution of $\gamma$-$\gamma'$ is identical in both cases, as is the absence of secondary carbides, the latter having been dissolved in the course of treatment.

The examination of the effect of the treatment upon protection has revealed an increase of its thickness. This is due to the diffusion phenomena brought into play during the dissolving treatment. Sulfurizing corrosion tests by sweeping with chlorine-enriched and sulfur-enriched combustion gases have been carried out in order to compare new aluminized blades with aluminized blades having operated for 900 hours and treated according to the method of the invention. After 250 hours observations make it possible to conclude that the efficiency of protection is not harmed by the treatment, because, if corrosion kinetics are essentially increased by the diffusion of the aluminium in the substrate, they are compensated for by an increase in the thickness of the protective deposit.

Figure 10:
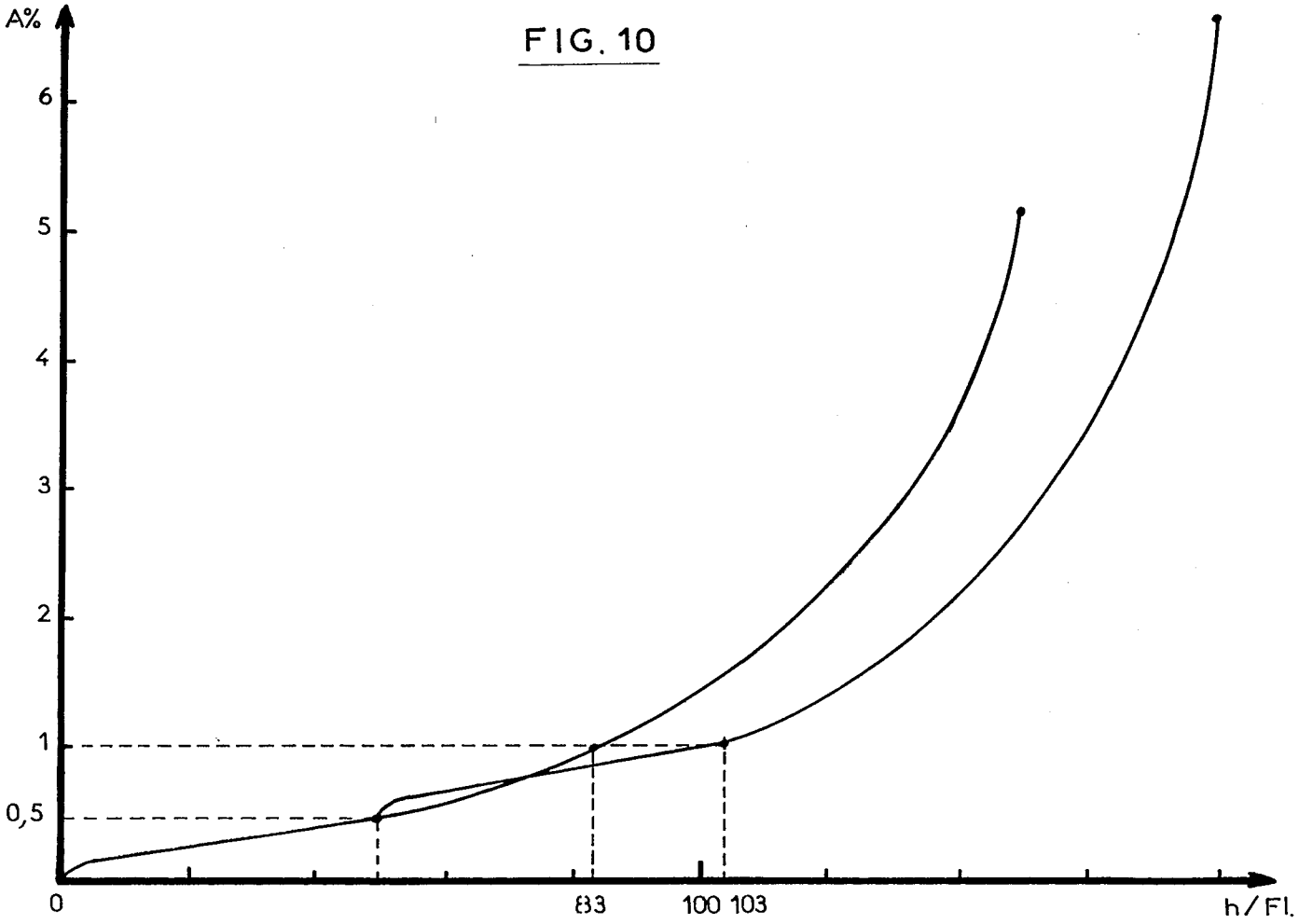
FIG. 10 is a time-elongation graph showing the creep behaviour of a test piece, respectively without regeneration and with 0.5% elongation regeneration.

Tests were also conducted on test pieces in order to characterise them in creep terms. Test pieces of alloy IN 100 underwent 0.5%, 1% and 3% elongation under a stress of 130 MPa at 1000° C.; as an operation-on-engine equivalent, 1% elongation is equivalent to 800 hours of operation for the above-mentioned conditions. The test pieces were regenerated, and then remounted to allow further creep. The test results for a piece regenerated at 0.5% elongation are shown in FIG. 10. It will be noted that, under test conditions, the alloy after regeneration exhibits primary and secondary creep stages.

The maximum improvement is obtained when treatment is effected after a 0.5% predeformation. It is observed that if the time required to obtain 1% elongation is 83±10 hours, the time to obtain this same elongation after a treatment at 0.5% elongation becomes 103±16 hours, i.e. a gain of 24%.

The improvement is similar with regard to the time before fracture occurs. It is 145 hours normally, but is 180 hours after regeneration at 0.5% elongation, as shown in FIG. 10.

These observations make it possible to establish that for the test pieces the duration of the stationary stage ends a little before 0.5% elongation and represents the limit of maximum deformation to undertake regeneration. After 1% elongation, the combined effects of the development of the cavities and of the oriented coalescence of the $\gamma'$ tend to reduce the effectiveness of the treatment.

A comparison of the microstructural observations between test pieces and blades where, for the former, differences of morphology in dentritic $\gamma'$ and interdendritic $\gamma'$ remain after treatment whereas in the case of blades they do not, shows that the damage suffered by a blade at the end of its useful life is less than that of a test piece after 0.5% elongation. This suggests the prospect of improvements in practice greater than those established for test pieces.

It follows from the foregoing statement that a blade which has exhausted its creep allowance after 800 hours' operation is regenerated by a heat treatment embodying the invention. Comparative examinations on parts and test pieces, taking account of their respective damage processes, suggest that there is a prospect of an improvement in excess of 30% on the useful operational life of the blades.

When the parts have gone beyond the secondary creep but do not exhibit opening-out decohesions, it is possible to combine this treatment with a preliminary hot isostatic compacting treatment of the known type, and which consists in holding the parts for 4 hours at 1190° C. under a pressure of at least 1000 bars.

What we claim is:

1. A method for regenerating a machine part of cast nickel-based alloy comprising a hardening phase $\gamma'$, at the end of its useful operational life as a result of creep damage, comprising the steps of:

holding said part at a temperature and for a period of time sufficient to redissove at least 50% of the volumetric fraction of the hardening phase $\gamma'$, said temperature being below the melting temperature of the eutectic, and then cooling said part, wherein the rate of said cooling is controlled to be between 600° C./hr and 2500° C./hr down to a temperature below 700° C., in accordance with the microstructural morphology to be regenerated, wherein said alloy consists essentially of 13–17 wt % Co, 8–11 wt % Cr, 5–6 wt % Al, 4–5 wt % Ti, 2–4 wt % Mo, 0.7–1.7 wt % Va, 0.1–0.2 wt % C, the balance being Ni.

2. The method of regeneration of a machine part according to claim 1, wherein the temperature of re-dissolving lies between 1160° C. and 1220° C., and the period at which this temperature is held is between one hour and four hours.

3. Method of regeneration according to claim 1, wherein the cooling rate is controlled to be between 1085° C./h and 1145° C./h.

4. Method of regeneration, according to claim 1, of a machine part having undergone treatment for protection against corrosion by aluminization, wherein the temperature of re-dissolving is selected to be below the critical dilution temperature of the protective deposit, in such a manner that the protection is still effective after treatment.

5. Method of regeneration according to claim 4, wherein the temperature of re-dissolving lies between 1185° C. and 1195° C.

6. Method of regeneration according to claim 1, for machine parts exhibiting non-opening-out decohesions, wherein they are subjected to a preliminary hot isostatic compacting treatment.

7. A method of regeneration of a machine part of cast nickel-based alloy comprising a hardening phase $\gamma'$, at the end of its useful operational life as a result of creep damage, comprising the steps of holding said part at a temperature of between 1160° C. and 1220° C. for at least one hour to redissolve at least 50% of the volumetric fraction of the hardening phase $\gamma'$, said temperature being below the melting temperature of the eutectic, and then cooling the said part at a controlled rate of cooling down to a temperature above 700° C. but below the range of temperatures at which precipitation of the $\gamma'$ phase takes place, said cooling rate being selected in accordance with the microstructural morphology to be regenerated in the said part, wherein said alloy consists essentially of 13–17 wt. % Co, 8–11 wt. % Cr, 5–6 wt. % Al, 4–5 wt. % Ti, 2–4 wt. % Mo, 0.7–1.7 wt. % Va, 0.1–0.2 wt. % C, the balance being Ni.

8. The method of claim 1, wherein said alloy further comprises Mn, Si and B.

9. The method of claim 8, wherein said alloy comprises 0.2 wt % Mn, 0.2 wt % Si and 0.01 wt % B.

* * * * *

UNITED STATES PATENT AND TRADEMARK OFFICE

CERTIFICATE OF CORRECTION

PATENT NO. : 4,753,686

DATED : June 28, 1988

INVENTOR(S) : JOSE COMPANY ET AL

It is certified that error appears in the above-identified patent and that said Letters Patent is hereby corrected as shown below:

Column 1, line 35, delete "danager" and insert --danger--.

Column 4, line 21, delete "solidifed" and insert --solidified--.

Column 4, line 27, delete "integranular" and insert --intergranular--.

Column 6, line 66, delete "dentritic" and insert --dendritic--.

Column 7, line 27, delete "redissove" and insert --re-dissolve--.

Signed and Sealed this

Third Day of January, 1989

*Attest:*

*Attesting Officer*

DONALD J. QUIGG

*Commissioner of Patents and Trademarks*